US007018973B2

(12) United States Patent
Katz

(10) Patent No.: US 7,018,973 B2
(45) Date of Patent: Mar. 28, 2006

(54) COMPOSITIONS USEFUL AS RINSE CYCLE FABRIC SOFTENERS

(75) Inventor: Manfred Katz, Wilmington, DE (US)

(73) Assignee: Optimer, Inc., Wilmington, DE (US)

( * ) Notice: Subject to any disclaimer, the term of this patent is extended or adjusted under 35 U.S.C. 154(b) by 0 days.

(21) Appl. No.: 11/032,707

(22) Filed: Jan. 11, 2005

(65) Prior Publication Data

US 2005/0119155 A1 Jun. 2, 2005

Related U.S. Application Data

(62) Division of application No. 10/290,595, filed on Nov. 8, 2002, now Pat. No. 6,881,715.

(51) Int. Cl.
*C11D 1/835* (2006.01)

(52) U.S. Cl. ..... 510/466

(58) Field of Classification Search ..... 510/466, 510/504, 522, 527
See application file for complete search history.

(56) References Cited

U.S. PATENT DOCUMENTS 5,482,703 A * 1/1996 Pings ..... 424/70.12
6,143,286 A * 11/2000 Bhambhani et al. ..... 424/70.1

FOREIGN PATENT DOCUMENTS

WO WO 01/60961 * 8/2001

* cited by examiner

*Primary Examiner*—John R. Hardee
(74) *Attorney, Agent, or Firm*—Woodcock Washburn LLP

(57) ABSTRACT

Compositions and methods of treating textiles are disclosed. More specifically, stable compositions and methods for softening a wide range of fabrics are disclosed, including 100% cotton and hydrophobic synthetic fabrics, without detrimentally affecting the water absorbency properties of the fabrics. The compositions may contain at least one fatty material and at least one polyorganosiloxane.

12 Claims, No Drawings

COMPOSITIONS USEFUL AS RINSE CYCLE FABRIC SOFTENERS

CROSS-REFERENCE TO RELATED APPLICATIONS

This application is a divisional application of U.S. application Ser. No. 10/290,595 filed Nov. 8, 2002, now U.S. Pat. No. 6,881,751, the entire disclosure of which is incorporated herein by reference.

FIELD OF THE INVENTION

The present invention generally relates to compositions and methods of treating textiles and, more specifically, to compositions and methods of treating textiles with compositions containing a fatty material and a polyorganosiloxane, particularly those useful as rinse cycle fabric softeners.

BACKGROUND OF THE INVENTION

Fabric softeners are widely used by home consumers and commercial laundries to provide softness, surface smoothness, good draping qualities, fluffiness and antistatic properties while avoiding surface greasiness or excessive build-up on the fabric. Although fabric softener technology is well known, the exact softening mechanism is not known. One commonly accepted mechanism relates softness to the lubricity of the adsorbed softener on the cloth and the consequent reduction of friction between the fabric fibers.

Fabric softener compositions that can be added to the rinse water when washing household laundry normally contain, as active substance, a water-insoluble quaternary ammonium compound. Commercially available fabric softener compositions are based on aqueous dispersions of water-insoluble quaternary compounds. Recently, there has been increasing interest in biodegradable active substances. Such substances include, for example, esters of quaternary ammonium compounds, so-called "esterquats," which have at least one long-chain hydrophobic alkyl or alkenyl group interrupted by carboxyl groups.

Active substances in fabric softener compositions that impart a good soft handle to the treated textile generally have the disadvantage that they may lower the water absorbency and wickability of the textile fabric. This is troublesome in the use of 100% cotton items, such as towels and diapers, where softness and water absorbency properties are both desired. The problem is generally exacerbated in more hydrophobic synthetic fibers, such as polyester, polypropylene and nylon and blends thereof with other synthetic and natural fibers. The problem may be so severe that many garments made from high performance fabrics where the ability to rapidly wick water from the skin and dry quickly actually include warnings against using any fabric softener during the laundering process because the use of the fabric softener may destroy the water-absorbency, rewettability and wickability properties of the fabric—properties key to their performance. The disadvantage of reduced water absorbency is often highly pronounced in the case of certain active substances, such as the fatty acid quats.

Others have addressed this trade-off in softness and water-absorbency properties. For example, U.S. Pat. No. 6,358,913 discloses a fabric softener composition containing:

(a) as an active substance, a quaternary ammonium compound of the formula:

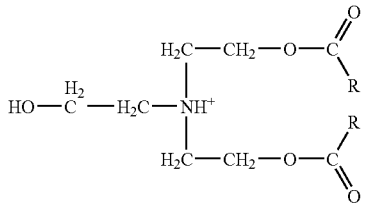

where R is the aliphatic radical of tallow fatty acid, in particular a mono- or polyunsaturated aliphatic $C_{17}$ radical; and (b) a nitrogen-free polydiorganosiloxane having terminal silicon-bonded hydroxyl groups.

However, there is still a need for additional fabric softener compositions that improve the water-absorbency, rewettability and wickability properties of the treated textiles without impairing the other desirable properties of the treated textiles provided by use of the compositions, such as softness and static properties. The present invention is directed to this, as well as other important ends.

SUMMARY OF THE INVENTION

The present invention is generally directed to compositions and methods of softening a wide range of fabric types, preferably without detrimentally decreasing water absorbency properties of the fabrics.

In one embodiment, the invention is directed to a composition, comprising:

a. at least one fatty material; and b. at least one water-soluble or water-dispersible polyorganosiloxane having substituents;

wherein said fatty material is:

i. a fatty acid quaternary ammonium compound having ester functionality;

ii. a fatty acid quaternary ammonium compound having amide functionality;

iii. a fatty acid alkoxylated quaternary ammonium compound;

iv. a nonionic fatty acid ester;

v. a fatty acid condensation product;

vi. an alkylmethyl quaternary ammonium compound;

vii. an amido alkoxylated quaternary ammonium compound;

viii. a quaternized amido imidazoline;

ix. a polyamine salt x. a polyalkylene imine salt; or xi. an alkyl pyridinium salt; and wherein said polyorganosiloxane is present at a level of at least about 35% by weight, preferably at least about 40%, based on the total weight of said fatty material and said polyorganosiloxane;

wherein said substituents comprise at least about 5% by weight, preferably at least about 10%, based on the total weight of said substituents, of non-terminal hydroxyl groups.

In certain preferred embodiments, the invention is directed to an aqueous composition. The compositions of the invention may be formulated with other optional components, including perfumes, colorants, preservatives and stabilizers. Such formulations may be in the form of aqueous suspensions or emulsions that may be conveniently added to the rinse water in the laundering process.

Particularly preferred fatty materials include:

i. a fatty acid quaternary ammonium compound having amide functionality;

ii. a fatty acid alkoxylated quaternary ammonium compound; or iii. a nonionic fatty acid ester.

In certain preferred embodiments, the polyorganosiloxane does not contain nitrogen. Preferably, the polyorganosiloxane has a melting point less than about 38° C., preferably less than about 35° C., more preferably less than about 30° C. and even more preferably less than about 25° C. Preferably, the polyorganosiloxane is liquid at room temperature to ensure ease of handling. The melting point may be measured by differential scanning calorimetry at a rate of 20° C./minute or in a capillary melting tube.

In another embodiment, the invention is directed to methods of treating a textile, comprising the step of contacting said textile with the composition described above. The compositions and methods of the invention may be used to treat a wide range of textile materials, from hydrophobic materials to hydrophilic materials to blends thereof. Preferably, the composition is added to the rinse water in the laundering process.

This invention relates to compositions and methods for conditioning fabrics during the rinse cycle of laundering operations. This is a widely used practice to impart to laundered fabrics a texture or handle that is smooth, pliable and fluffy to the touch (i.e. soft) and also to impart to the fabrics a reduced tendency to pick up and/or retain an electrostatic charge (i.e. static control), especially when the fabrics are dried in an automatic dryer. In addition, The compositions and methods of the invention enable improved softening and static control without detrimentally affecting the wickability of the fabrics.

The fatty material component useful in the compositions and methods of the invention may be cationic and nonionic substances that are substantive on textile fabrics and which are capable of imparting softness and/or lubricity to textile fabrics. The fatty material component is present at a level of less than about 65% by weight, preferably less than about 60%, based on the total weight of active ingredients of fatty material and polyorganosiloxane Suitable fatty materials include, for example:

i. fatty acid quaternary ammonium compounds having ester functionality;

ii. fatty acid quaternary ammonium compounds having amide functionality;

iii. fatty acid alkoxylated quaternary ammonium compounds;

iv. nonionic fatty acid esters;

v. fatty acid condensation products;

vi. alkylmethyl quaternary ammonium compounds;

vii. amido alkoxylated quaternary ammonium compounds;

viii. quaternized amido imidazoline;

ix. polyamine salt;

x. polyalkylene imine salt; and xi. alkyl pyridinium salts.

The fatty materials may be used individually or as admixtures with each other. For those fatty materials that are cationic, the counterparts preferably may be methyl sulfate or any halide.

Suitable fatty acid quaternary ammonium compound having ester functionality include, for example, ditallowdimethyl ammonium chloride, ditallowdimethyl ammonium methyl sulfate, and the like.

Suitable fatty acid quaternary ammonium compound having amide functionality include, for example, methyl bis (tallow amidoethyl) 2-hydroxyethyl ammonium methylsulfate and the like.

Suitable fatty acid alkoxylated quaternary ammonium compound include, for example, tallowdimethyl(3-tallowalkoxypropyl) ammonium chloride and the like.

Suitable nonionic fatty acid esters include glycerol monooleate, for example.

Suitable alkylmethyl quaternary ammonium compounds include, for example, those having either one alkyl chain containing about 18 to about 24 carbon atoms or two alkyl chains containing about 12 to about 30 carbon atoms, the long chain alkyl groups being most commonly those derived from hydrogenated tallow. Examples of such compounds are, tallowtrimethyl ammonium chloride, dieicosyldimethyl ammonium chloride, ditetradecyldimethyl ammonium chloride, didodecyldiethyl ammonium acetate and tallowtrimethyl ammonium acetate.

Suitable amido alkoxylated quaternary ammonium compounds, for example, may be prepared from fatty acids or triglycerides and an amine, for example, diethylene triamine. The product is then alkoxylated, for example, with ethylene oxide or propylene oxide and quaternized with an alkylating agent, for example, a methylating agent, such as dimethyl sulfate. Compounds may be represented by the formula:

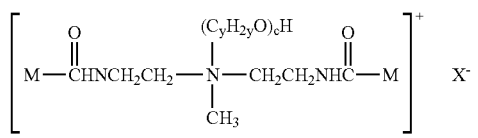

wherein M represents a fatty alkyl group typically about 12 to about 20 carbon atoms; X represents a halogen, such as Cl or Br, or a residue of the alkylating agent, for example, a methyl sulfate group; y is 2 or 3; and c is an integer.

Suitable quaternized amido imidazolines may be obtained, for example, by heating the alkoxylated product of the reaction product of an amine and a fatty acid or triglyceride as described for amido alkoxylated quaternary ammonium compounds to effect ring closure to the imidazoline. This is then quaternized by reaction with an alkylating agent, for example, dimethyl sulfate. An example of a quaternized amido imidazoline compound is 2-heptadecyl-1-methyl-1-(2'-stearoyl amidoethyl)-imidazolinium methyl sulfate.

Suitable polyamine salts and polyalkylene imine salts include, for example, $C_{12}H_{25}NH(CH_3)—(CH_2)_3—NH_2C_{12}H_{25}]^{+2}Cl_2^{-1}$;

$C_{18}H_{37}NH(CH_3)—(CH_2)_2—NH(C_2H_5)_2^{+2}]CH_3SO_4)^-{}_2$; and a polyethylene iminium chloride having about 10 ethylene imine units.

An example of a suitable alkyl pyridinium salt is cetyl pyridinium chloride.

The fatty materials that may be employed in the compositions and methods of the invention are well-known substances and have been widely described in the technical literature, see for example, *J. Am. Oil Chemists Soc.*, January 1978 (Volume 55), pages 118–121 and *Chemistry and Industry*, Jul. 5, 1969, pages 893–903, the disclosures of which are hereby incorporated herein by reference in their entirety.

The hydrophilic, water-soluble or water-dispersible polyorganosiloxanes having substituents that may be useful in the compositions and methods of the invention include linear or substantially linear siloxane polymers having at least about 5% by weight, based on the total weight of said substituents, of non-terminal hydroxyl groups. The average number of non-terminal hydroxyl groups per silicon atom may be determined using $^{29}$Si-NMR spectroscopy. The non-terminal hydroxyl groups may be bonded directly to the silicon atom. Alternatively, the non-terminal hydroxyl group may be bonded to a pendant group attached to the silicon atom.

As used herein, the term "water-soluble polyorganosiloxane" means a polyorganosiloxane having a water solubility at about 20° C. to about 50° C. of at least about 200 millimoles/liter in water. Such water-soluble polyorganosiloxanes form clear solutions upon addition to water, as observed visually by the naked eye. As used herein, the term "water-dispersible polyorganosiloxane" means a polyorganosiloxane having a water solubility at about 20° C. to about 50° C. of less than about 200 millimoles/liter in water. Such water-soluble polyorganosiloxanes form slightly turbid or slightly cloudy solutions upon addition to water, as observed visually by the naked eye.

The polyorganosiloxanes useful in the compositions and methods of the invention are commercially available from Bayer Corporation under the tradename REACTOSIL® RWS and from Crompton Corporation under the tradename MAGNASOFT™ HWS.

The polyorganosiloxanes useful in the compositions and methods of the invention may have a weight-average molecular weight of at least about 750, as measured by size exclusion chromatography. The polyorganosiloxanes preferably have a molecular weight ranging from about 1,000 to about 25,000 and all combinations and subcombinations of molecular weight ranges and specific molecular weights therein.

Preferably, the polyorganosiloxanes contains at least about 50% by weight, based on the total weight of substituents in the polyorganosiloxane, of methyl radicals. The balance of other non-hydroxyl organic substituents present may be monovalent hydrocarbons having from about 2 to about 30 carbon atoms and all combinations and subcombinations of ranges and specific number of carbon atoms therein. Examples of suitable monovalent hydrocarbon radicals having from about 2 to about 30 carbon atoms include alkyl or cycloalkyl radicals, such as ethyl, propyl, butyl, n-octyl, tetradecyl, octadecyl or cyclohexyl, alkenyl radicals, such as vinyl or allyl, and aryl or aralkyl radicals, such as phenyl or tolyl.

The total weight of active ingredients of fatty materials and polyorganosiloxanes is not critical and depends upon individual practical and commercial considerations. For example, the compositions should be sufficiently fluid as to be readily dispersible during the laundering operation. Also, they should preferably not be so dilute as to involve the cost of storing or transporting large volumes of water. With regard to cost considerations, the preferred aqueous compositions are those wherein the active ingredients of fatty materials and polyorganosiloxanes are present at a level of about 5% to about 35% by weight and all combinations and subcombinations of weight % ranges and specific weight % therein, based on the total weight of the aqueous composition.

The compositions of the invention are preferably used in the form of aqueous emulsions. These emulsions can be prepared as follows: the fatty material(s) and polyorganosiloxane(s) are emulsified in water using one or more dispersants and shear forces, for example, by means of a colloid mill. Suitable dispersants are known to the person skilled in the art, for example, ethoxylated alcohols or polyvinyl alcohol may be used. The dispersants may be used in customary amounts known to the person skilled in the art and may be added either to the polysiloxane or to the water prior to emulsification. Where appropriate, the emulsification operation can, or in some cases, must be carried out at elevated temperature.

The compositions and methods of the invention may be used to treat a wide range of textile materials, from hydrophobic materials to hydrophilic materials to blends thereof. Suitable examples include silk, wool, polyester, polyamide, polyurethanes, and cellulosic fiber materials of all types. Such cellulose fiber materials are, for example, natural cellulose fibers, such as cotton, linen, jute and hemp, and regenerated cellulose. The compositions of the invention are also suitable for hydroxyl-containing fibers that are present in mixed fabrics, for example mixtures of cotton with polyester fibers or polyamide fibers.

The compositions of the invention may also contain additives that are customary for standard commercial fabric softeners, for example alcohols, such as ethanol, n-propanol, i-propanol, polyhydric alcohols, for example glycerol and propylene glycol; amphoteric and nonionic surfactants, for example carboxyl derivatives of imidazole, oxethylated fatty alcohols, hydrogenated and ethoxylated castor oil, alkyl polyglycosides, for example decyl polyglucose and dodecylpolyglucose, fatty alcohols, fatty acid esters, fatty acids, ethoxylated fatty acid glycerides or fatty acid partial glycerides; also inorganic or organic salts, for example water-soluble potassium, sodium or magnesium salts, non-aqueous solvents, pH buffers, perfumes, dyes, hydrotropic agents, antifoams, antiredeposition agents, polymeric or other thickeners, enzymes, optical brighteners, antishrink agents, stain removers, germicides, fungicides, antioxidants, corrosion inhibitors and anticrease agents.

EXAMPLES

Example 1

The compositions listed in Table 1 below were prepared by adding glycerol monooleate (KEMESTER® 2000 from Crompton Corporation) (fatty material) and a 33% aqueous solution of an organomodified polydimethyl siloxane (having greater than 5% non-terminal hydroxyl groups) solution (REACTOSIL® RWS from Bayer Corporation) to water in 4 ounce jar and shaking the jar vigorously for about one minute.

The stability of the emulsion formed is judged visually by observing without the aid of instrumentation whether there is any visual separation of the mixture into layers upon standing one to seven days at ambient temperature of about 20° C. to about 40° C. A stable emulsion is generally a uniformly white, smooth liquid.

The testing for wicking and softness properties imparted by the compositions were determined by adding about 30 ml of the composition to the final rinse water of an automatic washing machine containing a mix of clothing of 100% polyester, 85/15 polyester/cotton, 50/50 polyester/cotton and 100% cotton fabrics. After spinning in the washing machine and tumble drying in an electric dryer, the fabrics were tested for horizontal wickability by observing the time for absorption of a droplet of water placed onto the dry fabric. Softness was determined subjectively on the 100% cotton garment since it was the most critical to the typical consumer. The test results are shown in Table 1.

TABLE 1

| | | Active Ingredients | | Testing | | |
|---|---|---|---|---|---|---|
| | % Active Ingredients | Fatty Material Component (a) | Siloxane Component (b) | | | |
| ID | [% (a) + (b) in composition] | [% of (a) in (a) + (b)] | [% of (b) in (a) + (b)] | Emulsion Stability | Wicking | Softness |
| 1 (comparative) | 50 | 70 | 30 | Not stable | — | — |
| 2 (comparative) | 45 | 70 | 30 | Not stable | — | — |
| 3 | 48 | 65 | 35 | Stable | Excellent | Excellent* |
| 4 | 24 | 65 | 35 | Stable | Excellent | Excellent |
| 5 | 55 | 60 | 40 | Stable | Excellent | Very good |
| 6 | 46 | 60 | 40 | Stable | Excellent | Very good |
| 7 | 40 | 60 | 40 | Stable | Excellent | Very good |
| 8 | 50 | 50 | 50 | Stable | Excellent | Good |

*Fabrics treated with compositions 3–8 exhibited a dry softness rather than the slick softness found in fabrics treated with Downy ® fabric softener.

As can be seen from Table 1, the % active ingredient does not appear to affect the stability of the composition. However, the composition must contain at least 35% by weight of the siloxane component, based on the total weight of the active ingredients to form stable compositions. All of the compositions of the invention (ID 3–8) were stable and exhibited excellent wicking properties. All of the compositions of the invention (ID 3–8) exhibited at least good softness. The softness characteristics improved from good to very good to excellent as the level of fatty component increased from 50% to 60% to 65%, based on the total weight of the active ingredients.

Example 2

Three hundred grams of a 33% aqueous solution of an organomodified polydimethyl siloxane (having greater than 5% non-terminal hydroxyl groups) solution (REACTOSIL® RWS from Bayer Corporation) were added to 150 g of glycerol monooleate (KEMESTER® 2000 from Crompton Corporation)(fatty material) in a one-liter jar to yield a 40/60 weight ratio of glycerol monooleate to siloxane. This mixture was vigorously shaken for about one minute to form a smooth viscous emulsion. Four grams of fragrance (Rain Fresh type #4855-AAE WS from Horizon Aromatics) was added to 171 g of water to form a milky liquid after mixing. This milky liquid was added to the jar containing the emulsion of glycerol monooleate and siloxane and vigorously shaken for about one minute. This stable emulsion contained 40% active ingredients.

One hundred milliliter samples were given to four different people for evaluation. All of the testers were pleased with the wicking and softness imparted by the fabric softener; several commented on the improved drying of their cotton towels, i.e. quickness of removing water from the body.

Example 3

Example 2 was repeated, except that final emulsion of glycerol monooleate and siloxane contained 45% active ingredients. Several batches of this composition were prepared and 100 ml samples were given to 10 different people for testing in their home. All of the testers were pleased with the wicking and softness imparted by the softener; several commented on the improved drying power of their cotton towels, i.e. quickness of removing water from the body.

Example 4

To an Osterizer blender jar, 300 g of water was mixed with 100 g of an organomodified polydimethyl siloxane (having greater than 5% non-terminal hydroxyl groups) (MAGNASOFT HWS from Crompton Corporation). After blending for about one minute a somewhat viscous slightly cloudy 33% aqueous solution was obtained. One hundred fifty grams of glycerol monooleate (KEMESTER® 2000 from Crompton Corporation)(fatty material) were added and blended for about two minutes. A smooth, stable emulsion was formed containing 40% by weight siloxane and 60% by weight glycerol monooleate with 45% active ingredients.

About 30 ml of the emulsion containing the glycerol monooleate and siloxane were added to the rinse water cycle of an automatic washing machine containing a 100% polyester CoolMax® T-shirt, three 85%/15% polyester/cotton (Dri-release®) T-shirts and one 100% cotton T-shirt. After spinning in the washing machine and tumble drying in an automatic electric dryer all the shirts wicked a drop of water instantly and felt soft.

Example 5

In a 4-ounce glass jar, 30 g of an organomodified polydimethyl siloxane (having greater than 5% non-terminal hydroxyl groups) solution (REACTOSIL® RWS from Bayer Corporation) were mixed with 15 g of a liquid containing 90% methyl bis (tallow amidoethyl) 2-hydroxyethyl ammonium methylsulfate (fatty material) and 10% isopropanol (VARISOFT 222 LM 90 from Crompton Corporation). On shaking a very viscous stable emulsion resulted with a ratio of 42.5% siloxane to 57.5% fatty material and 52% active ingredients. Forty-nine grams of water was added to the very viscous emulsion and the mixture was shaken to form a very fluid stable emulsion with 25% active ingredients.

About 40 ml of the emulsion containing fatty material and siloxane was added to the rinse water cycle of an automatic washing machine containing three 85%/15% polyester/cotton (Dri-release®) T-shirt, one 100% cotton T-shirt and one 100% polyester (CoolMax®) T-shirt. After spinning in the washing machine and tumble drying in an automatic electric dryer, all of the shirts wicked a drop of water instantly and felt soft with some slickness like that obtained with DOWNY® fabric softener.

Example 6

In a 4-ounce glass jar, 30 g of an organomodified polydimethyl siloxane (having greater than 5% non-terminal hydroxyl groups)(REACTOSIL® RWS from Bayer Corporation), 22.1 g water and 15 g of a liquid containing 90% methyl bis (tallow amidoethyl) 2-hydroxyethyl ammonium methylsulfate (fatty material) and 10% isopropanol (VARISOFT 222 LM 90 from Crompton Corporation) were mixed. On shaking, a stable emulsion of about the appropriate viscosity expected by consumers resulted having a ratio of 42.5% by weight siloxane and 57.5% fatty material with 35% active ingredients. After standing overnight, 0.34 g (0.5%) of fragrance (Rain Fresh type #4855-AAE WS from Horizon Aromatics) were added to the stable emulsion and shaken to mix it well. Addition of the fragrance had no effect on emulsion stability.

When ranges are used herein for physical properties, such as molecular weight, or chemical properties, such as chemical formulae, all combinations and subcombinations of ranges and specific embodiments therein are intended to be included.

The disclosures of each patent, patent application and publication cited or described in this document are hereby incorporated herein by reference, in their entirety.

Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

What is claimed is:

1. A composition, comprising:

a. at least one fatty material; and b. at least one water-soluble or water-dispersible polyorganosiloxane having substituents;

wherein said fatty material is:

i. a fatty acid quaternary ammonium compound having ester functionality;

ii. a fatty acid quaternary ammonium compound having amide functionality;

iii. a fatty acid alkoxylated quaternary ammonium compound;

iv.

v. an alkylmethyl quaternary ammonium compound;

vi. an amido alkoxylated quaternary ammonium compound; or vii. quaternized amido imidazoline; and wherein said polyorganosiloxane is present at a level of at least about 35% by weight, based on the total weight of said fatty material and said polyorganosiloxane;

wherein said substituents comprise at least about 10% by weight, based on the total weight of said substituents, of non-terminal hydroxyl groups.

2. The composition of claim 1, wherein said polyorganosiloxane has a melting point less than about 38° C.

3. The composition of claim 1, wherein said polyorganosiloxane does not contain nitrogen.

4. The composition of claim 1, wherein said fatty material is:

i. a fatty acid quaternary ammonium compound having amide functionality; or ii. a fatty acid alkoxylated quaternary ammonium compound.

5. An aqueous composition, comprising:

a. water; and b. the composition of claim 1.

6. The aqueous composition of claim 5, wherein the composition is in the form of an emulsion or suspension.

7. A method of treating a textile, comprising the step of contacting said textile with a composition comprising:

a. at least one fatty material; and b. at least one water-soluble or water-dispersible polyorganosiloxane having substituents;

wherein said fatty material is:

i. a fatty acid quaternary ammonium compound having ester functionality;

ii. a fatty acid quaternary ammonium compound having amide functionality;

iii. a fatty acid alkoxylated quaternary ammonium compound;

iv.

v. an alkylmethyl quaternary ammonium compound;

vi. an amido alkoxylated quaternary ammonium compound; or vii. quaternized amido imidazoline; and wherein said polyorganosiloxane is present at a level of at least 35% by weight, based on the total weight of said fatty material and said polyorganosiloxane;

wherein said substituents comprise at least 10% by weight, based on the total weight of said substituents, of non-terminal hydroxyl.

8. The method of claim 7, wherein said polyorganosiloxane has a melting point less than about 38° C.

9. The method of claim 7, wherein said polyorganosiloxane does not contain nitrogen.

10. The method of claim 7, wherein said fatty material is:

i. a fatty acid quaternary ammonium compound having amide functionality; or ii. a fatty acid alkoxylated quaternary ammonium compound.

11. The method of claim 7, wherein said textile is made from hydrophilic fibers, hydrophobic fibers or a combination thereof.

12. The method of claim 7, wherein said composition is added to the rinse water in the laundering process.

* * * * *